US009004795B2

(12) United States Patent
Salciarini

(10) Patent No.: US 9,004,795 B2
(45) Date of Patent: Apr. 14, 2015

(54) CONTAINER FOR A STICK OF A COSMETIC OR HYGIENIC PRODUCT HAVING A RETRACTABLE APPLICATOR ELEMENT

(75) Inventor: Christian Salciarini, Couilly Pont aux Dames (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 189 days.

(21) Appl. No.: 13/518,837

(22) PCT Filed: Dec. 22, 2010

(86) PCT No.: PCT/FR2010/052869

§ 371 (c)(1),
(2), (4) Date: Jun. 22, 2012

(87) PCT Pub. No.: WO2011/077042

PCT Pub. Date: Jun. 30, 2011

(65) Prior Publication Data

US 2012/0248006 A1 Oct. 4, 2012

(30) Foreign Application Priority Data

Dec. 23, 2009 (FR) ..... 09 59455

(51) Int. Cl.
*B43K 5/16* (2006.01)
*A45D 40/06* (2006.01)
*A45D 40/10* (2006.01)

(52) U.S. Cl.
CPC ..... *A45D 40/06* (2013.01); *A45D 40/10* (2013.01)

(58) Field of Classification Search
USPC ..... 401/109–112, 131, 99; 206/385; 200/523, 524
See application file for complete search history.

(56) References Cited

U.S. PATENT DOCUMENTS

| | | | | |
|---|---|---|---|---|
| 5,102,249 | A | 4/1992 | Holloway et al. | |
| 7,874,753 | B2 * | 1/2011 | Domy et al. | 401/99 |
| 8,353,636 | B2 * | 1/2013 | Drugeon et al. | 401/107 |

FOREIGN PATENT DOCUMENTS

| | | |
|---|---|---|
| EP | 1721543 | 11/2006 |
| FR | 2870092 | 11/2005 |
| WO | WO 2005/079622 | 9/2005 |
| WO | WO 2006/120336 | 11/2006 |
| WO | WO 2009/101268 | 8/2009 |

* cited by examiner

*Primary Examiner* — David Walczak
(74) *Attorney, Agent, or Firm* — Hunton & Williams LLP

(57) ABSTRACT

A container (1) for a stick of a cosmetic or hygienic product, comprising an applicator element (3) in which a stick (2) of said product can move axially relative to a base (32), as well as a tubular storage element (4) comprising a top (41) that contains a mobile sleeve (42) and is suitable for covering the applicator element (3) in a configuration wherein said applicator element is fully inserted into the sleeve and connected to said top by means of an elastically compressible device having two stable axial positions relative to a hilly inserted configuration, said device comprising a resilient element (43) pushing the sleeve (42) towards the outside of the top, and, distributed between the top and the sleeve, a heart-shaped guide track (44) arranged parallel to an axial direction of the top, and a follower (45) carried by a generally axially pivoting arm (46) such as to define stable top and bottom positions allowing the applicator element to be gripped or not. The resilient element (43) is arranged between the outer wall of the sleeve (42) and the inner wall of the top (41), and the guide track and follower are arranged in a lateral space formed by the shape differences of the cross-sections of the top and the sleeve.

12 Claims, 3 Drawing Sheets

CONTAINER FOR A STICK OF A COSMETIC OR HYGIENIC PRODUCT HAVING A RETRACTABLE APPLICATOR ELEMENT

CROSS-REFERENCE TO RELATED APPLICATIONS

This application is the U.S. National Phase of International Application No. PCT/FR2010/052869 filed on Dec. 22, 2010, which claims priority to French Application No. FR 0959455, filed Dec. 23, 2009.

FIELD OF THE INVENTION

The invention relates to a container for a stick of cosmetic or hygienic product having an applicator element which is engaged, apart from during periods of application of the product, in a tubular storage and protection element; it applies in particular to lip make-up cases, and in particular to lipstick cases, the stick of which is formed by a make-up product, the color of which need not be a shade of red. It may also relate to a hygienic salve, in particular for protection of the lips against the aggressiveness of the environment.

BACKGROUND

Lipstick containers (or cases) conventionally comprise an applicator element, sometimes known as a mechanism, comprising a support which bears a stick of lipstick, a tubular body (which has or does not have a circular cross-section) in which the support can be displaced axially as required, by relative movement of rotation between this tubular body and a base to which this tubular body is connected axially, such as to extend the stick or on the other hand to retract it in the tubular body, as well as a tubular storage element formed by a cap or lid which co-operates with the base and the tubular body in order to enclose and protect the stick when the user does not need it. This tubular body and this tubular element can have cross-sections which are or are not circular.

For stick product containers of this type, structures have already been proposed wherein the cap (i.e. the tubular element) contains a sleeve which is designed to receive the tubular body of the applicator element, this sleeve being mobile relative to the base of this top, between a configuration of maximum insertion, in which the applicator element, including its base, is at least approximately retracted in the top, and a configuration of minimum insertion, in which, although it is engaged solidly in this sleeve, this applicator element projects, in practice from its base, along a distance which is sufficient to allow it to be grasped by the fingers of a user.

Thus, documents WO-2005/079622 and WO-2006/120336 have proposed structures wherein the applicator element can be fully retracted into the cap (to an extent sufficient to prevent a user from being able to grasp this element sufficiently to extract it from the top), whereas a bistable element which is arranged in the cap makes it possible, after a movement of insertion from this retraction position, to give rise to the projection of this applicator element from the top, over a distance which is sufficient to allow it to be grasped by a user. The bistable device in the cap is formed mainly firstly by an axial track in the form of a loop, which is integral with the sleeve, in which a pin which is connected to the cap is designed to circulate, and secondly by a spring which tends to thrust the sleeve towards the exterior.

In addition, document WO-2009/101268 has proposed a structure wherein, for reasons of simplicity, reliability and appearance, the applicator element can in the same way be retracted or made to project not by means of a bistable device, but by means of a pin which is accessible from the exterior, and makes it possible to command movements between these configurations.

A problem consists in the fact that, when the movements between the retracted and projecting configurations make a bistable device intervene (see the first two aforementioned documents), this device is situated axially between the base of the cap and that of the sleeve, with the result that the sleeve has an axial dimension which is substantially smaller than that of the top, with the disadvantage that the volume which is available in the cap in order to receive the applicator element is substantially smaller than the global inner volume of this top.

In fact, according to FR-2 870 092 another structure is known, the cap of which comprises a sleeve with two positions which are determined by a bistable device. Part of the bistable device, i.e. a track in the form of a loop and the pin which is designed to circulate in it, is situated there between the lateral walls of the cap and the sleeve, which a priori reduces the axial dimension of this bistable device between the bases of the cap and the sleeve. However, firstly this structure comprises a spring which is interposed between these bases, which prevents optimum reduction of the axial dimension of the bistable device, but also, the structure proposed by this document does not permit easy movements of the sleeve between its stable configurations, since the pin which is designed to circulate in the track in the form of a loop (provided in the thickness of the wall of the sleeve) is integral with a ring which is designed to slide circumferentially in an annular groove provided in the thickness of the top; however, it will be appreciated that an insertion force on the applicator element tends to push the pin towards the base of the top, and therefore push the ring against one of the sides of the groove, thus giving rise to friction or even wedging which could impede the movements of the sleeve.

SUMMARY OF THE INVENTION

The object of the invention is to overcome these disadvantages by proposing a container for a stick of cosmetic or hygienic product which complies with the same criteria of simplicity, reliability and appearance as the structures according to documents WO-2005/079622 and WO-2006/120336, the cap of which comprises a mobile sleeve, the movements of which are determined by a bistable device with a track in the form of a loop and a follower, but the volume of which available to receive the applicator element is scarcely smaller than the inner volume of the top, whilst minimizing the friction and risks of wedging in this bistable device.

For this purpose, the invention proposes a container for a stick of cosmetic or hygienic product, comprising firstly an applicator element comprising a base and a tubular body which is connected axially to this base, and wherein a stick of this product can be displaced axially relative to the base, as well as a tubular storage element comprising a cap which contains a mobile sleeve, is designed to cover the applicator element in a configuration of maximum insertion of this applicator element in the sleeve, and is connected to this cap by a resiliently compressible device with two axial positions which are stable relative to a configuration of maximum insertion, comprising a resilient element which thrusts the sleeve towards the exterior of the top, and, distributed between the cap and the sleeve, a heart-shaped guide track which is arranged parallel to an axial direction of the top, and a follower finger which is supported by an axial arm which pivots globally such as to be designed to follow this guide track so that, when the follower finger is situated in the wedge-shaped area of the portion in the form of a "W" of this heart-shaped track, whilst the sleeve is engaged to the maximum extent in the sleeve, this sleeve is in a low stable configuration in which the applicator element is retracted sufficiently in the sleeve to prevent grasping by the fingers of a user, with the other stable position of the resiliently compressible device defining for the sleeve a configuration in which, although this applicator element is engaged to the maximum extent in the sleeve, it projects far enough from the cap to provide the fingers of a user with sufficient grip to extract the applicator element from the top, characterized in that the resilient element is arranged between the outer wall of the sleeve and the inner wall of the top, and, with the inner wall of the cap and the outer wall of the sleeve having transverse cross-sections with differences of form which delimit at least one lateral space, the guide track and this follower are arranged in this lateral space thus formed.

Thus, the invention teaches arrangement of at least a part of the components of the resiliently compressible device adjacent to the sleeve, in a free space derived from the difference of form of the cross-sections of the cap and of the sleeve.

Advantageously, the transverse cross-section of the sleeve is circular, whereas the transverse cross-section of the cap has lateral spaces distributed circumferentially around the sleeve, which corresponds to simple forms. More particularly, and preferably, the transverse cross-section of the cap has a form which is at least approximately polygonal, the lateral space being situated in a wedge-shaped area of this form.

Preferably, for reasons of simplicity of production, the sleeve and the cap in particular have constant cross-sections along their entire axial length.

Advantageously, the resilient element is situated axially between the assembly of the guide track and the follower, and the open end of the top.

Also advantageously, said resiliently compressible device additionally comprises axial support surfaces which are provided respectively on the sleeve and on the top, and which, by means of their axial support against one another under the effect of the resilient element, determine said other stable position. More particularly, and preferably, the heart-shaped guide track has, opposite said portion in the form of a "W", a wedge-shaped portion which is extended by an axial track portion.

Advantageously, the heart-shaped guide track and the follower are distributed between an end part of the sleeve close to the base of the top, and an added-on part which is engaged in said lateral space inside the cap near to its base. Preferably, the added-on part and the end part of the sleeve comprise axial support surfaces which, by means of their axial support against one another under the effect of the resilient element, determine said other stable position. Even more preferably, the added-on part is formed such as to permit transverse engagement of the sleeve in this added-on part. Also preferably, the resilient element is arranged axially around the sleeve between support surfaces which are provided respectively on said added-on part and the sleeve, near to its open end.

Advantageously, the heart-shaped guide track is integral with the cap near to its base, whereas the arm which connects the follower to the sleeve is fitted such as to pivot around a transverse axis arranged in the vicinity of the base of the sleeve.

BRIEF DESCRIPTION OF THE FIGURES

Objectives, characteristics and advantages of the invention will become apparent from the following description, provided by way of non-limiting example, with reference to the attached drawings, in which.

DETAILED DESCRIPTION OF PREFERRED EMBODIMENTS

Figure 1:
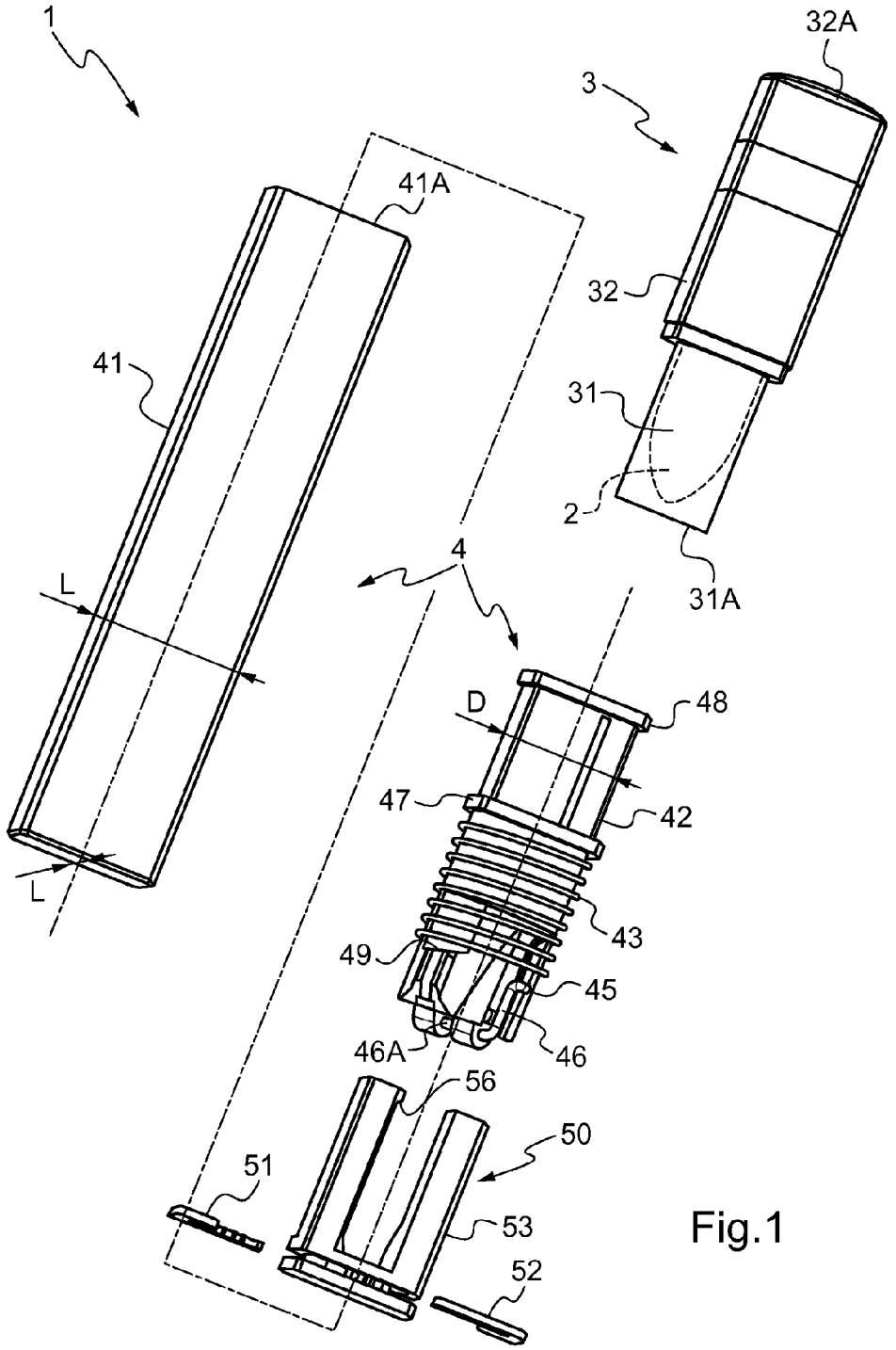
FIG. 1 is a partly exploded view in perspective of a container for a stick of makeup according to one embodiment of the invention.

FIG. 1 represents a container 1 according to the invention. This container contains a stick 2 of a solid product which is designed to be applied to the lips of a female user (or a male user, in the case in particular of a hygienic product for protection of the lips, for example against the effects of the cold).

This container comprises mainly an applicator element 3 which is designed to permit application of the product onto lips, and a tubular storage element 4 which is designed to cover this applicator element in the inactive rest configuration (when the user is not using this element). In practice, the product is retracted in the applicator element in this inactive rest configuration.

In fact, the applicator element 3 comprises a tubular body 31 in which the stick 2 can be displaced axially, by relative movement of rotation between this tubular body 31 and a base 32 to which this tubular body is connected axially; this explains why the tubular body is generally circular, whereas the base can have a wide variety of forms.

The tubular storage element 4 comprises a cap 41 containing a mobile sleeve 42, both of which are elongate according to an axial direction which is represented in FIG. 1 by the broken line which joins the various components of this tubular element.

This cap is designed to contain the applicator element and the sleeve in a configuration of maximum insertion of the applicator element in the sleeve. In practice, only the tubular body penetrates into the sleeve, and this insertion is carried out by means of friction, such that, subsequently, it is the friction which retains this applicator element in the sleeve when the applicator element is not being used. In addition, in practice, the configuration of maximum insertion of the applicator element inside the sleeve is defined by the abutment of the free end 31A of the tubular body 31 against an annular support surface (not represented) which is provided inside the sleeve.

The mobile sleeve 42 is joined to the cap by a resiliently compressible device with two axial positions which are stable relative to a configuration of maximum insertion, which device will be described with reference to FIG. 2. This resiliently compressible device comprises mainly a resilient element 43 which is arranged such as to thrust the sleeve towards the exterior of the top, a heart-shaped guide track 44 which is arranged parallel to the axial direction of the cap (and is concealed in FIG. 1, but can be seen in FIG. 2), and a follower 45 which can follow this guide track. In order to facilitate the movements of this follower finger transversely to the axial direction, this finger is supported by an arm 46 which pivots globally axially, but is designed to adopt inclination which is limited relative to this axial direction. This arm 46 is fitted such as to pivot around a shaft 46A which is transverse to the axial direction; as can be seen in FIG. 1, it is advantageously fitted close to the base of the sleeve, and in this case below this base. It can be noted that the arm 46 with the follower at one end and the pivoting shaft at its other end is in the form of a crank.

In a variant (not represented), the pivoting arm is in fact integral with its support (in this case the sleeve), whilst having flexibility which is sufficient to allow the follower to follow lateral movements.

In the example considered here, in its low part in particular (close to the base of the top), the sleeve has a circular cross-section with a diameter D, whereas the cap has a constant cross-section with a polygonal form, and more precisely a square form with rounded edges, such that in FIG. 1 it has equal transverse dimensions which are indicated as L. The differences in form of the cross-sections of the sleeve (and more precisely the cross-section of its outer wall) and of the cap (more precisely the cross-section of its inner wall) result in the existence of lateral spaces at each of the corners. According to one aspect of the invention, one of these lateral spaces is used for accommodating the guide track and the follower which form part of the resiliently compressible device, which makes it possible for the base of the sleeve to descend in the cap as far as the vicinity of its base.

It will be appreciated that, when the sleeve and the cap have constant thicknesses, it is unnecessary to mention their cross-sections or specify the cross-section of the inner wall of the cap and the cross-section of the outer wall of the sleeve.

It can also be noted that the resilient element 43 is arranged between the outer wall of this sleeve and the inner wall of the top, which also contributes to the fact that the sleeve can descend into the cap as far as the vicinity of the base of the latter.

More specifically, this resilient element 43 which is preferably a spring, is advantageously arranged around the sleeve, whilst being situated between the assembly formed by the guide track 44 and the follower 45 on the one hand, and the open end of the top, indicated as 41A in FIG. 1, on the other hand.

It will be appreciated that, as a variant, the sleeve or the cap can have cross-sections which are not constant along their entire height (parallel to the axial direction), provided that there are differences of form for these cross-sections along a fraction of these heights which is sufficient to delimit at least one lateral space large enough to implant the guide track and the follower.

In this FIG. 1 it can also be noted that this resilient element is arranged in the lower part of the sleeve, and is abutted by a collar 47 which forms an axial support surface for this resilient element. This sleeve additionally comprises a collar 48 which borders the open end of this sleeve.

This FIG. 1 also represents an added-on part 50 which forms a cage, and is engaged in the low part of the cap in order to constitute the base thereof; in fact the cap is in this case constituted by a tube with a constant cross-section, wherein this part is secured in the cap in a known manner by means of lateral hooks 51 and 52. This added-on part 50 is formed such as to comprise axial uprights which are designed to engage in the cap around the low part of the sleeve, in at least some of the lateral spaces derived from the difference in form between the cross-sections of the cap and of the sleeve. It is in one of these uprights, indicated as 53, that the guide track is arranged (as previously stated, this guide track cannot be seen in FIG. 1: in fact it is concealed by the thickness of this upright, since this track faces the finger which can in fact be seen in this FIG. 1). These uprights extend axially from a base which is designed to constitute the base of the top.

As a variant, the assembly can be fitted together using other hooking methods or any other assembly method, for example by gluing or crimping.

For reasons which will become apparent hereinafter, this added-on part advantageously has three uprights, which are designed to be engaged in three of the four lateral spaces situated in the four corners of the globally square cross-section of the top, and the guide track is etched on the middle upright.

Advantageously, the upper sections of the uprights define jointly a support surface for the resilient element 43, which, when the added-on part is in place in the top, is thus interposed between this support surface 55 and the support surface 47 which is provided on the outer surface of the sleeve. Thus, this resilient element tends to thrust the sleeve upwards, i.e. towards the exterior of the top.

Figure 2:
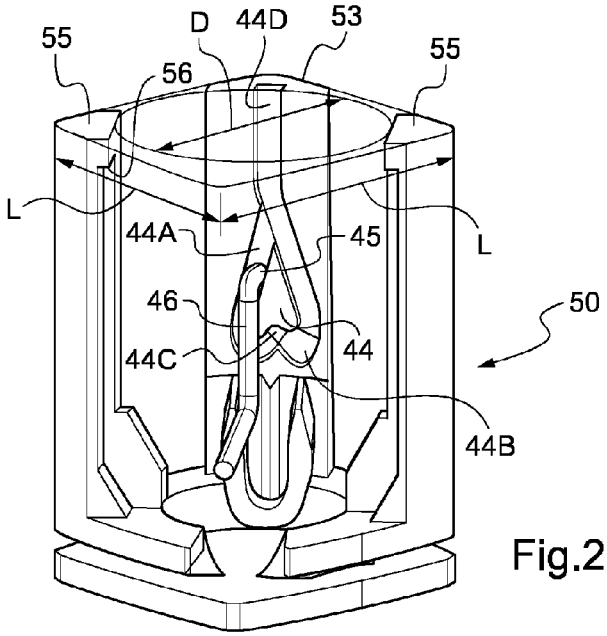
FIG. 2 is a view in perspective of part of the bistable compressible device of the device in FIG. 1.

The co-operation of this guide track and the follower is represented in FIG. 2, where the added-on part 50 has been rotated by 180° around its axis relative to its configuration in FIG. 1.

For reasons of visibility, the follower 45 is represented only with its support arm 46, without the sleeve which supports it.

The principle of this co-operation is similar to that described in the aforementioned document WO-2006/120336. As previously stated, the guide track 44 is heart-shaped; more particularly, this track comprises a portion in the form of a point 44A, in the high part, and a portion 44B in the form of a "W" in the low part. This track comprises notches in its base, such that the follower, which is subjected to a certain thrust towards this base of the track, can follow this track only in a single direction. In particular, when the follower is engaged in the wedge area 44C of the portion in the form of a "W", a relative movement of the finger downwards in relation to this track forces the finger to descend on a given side (on the left in the example in FIG. 2), as far as the base of a hollow of this form in the shape of a "W", then, after relative movement upwards, to slide along this track until it enters its portion in the form of a point 44A. On the other hand, during relative movement downwards from the position in 44A of this finger relative to the track, this finger is forced to descend via the branch of the heart other than the one via which it rose (and therefore via the right branch in the example in this FIG. 2) until it reaches the other hollow (the right-hand one) of the portion in the form of a "W"; relative movement of rising of the finger in relation to the track then allows the finger to return to the wedge-shaped area 44C of this portion in the form of a "W".

Advantageously, the track is extended beyond the portion in the form of a point 44A by an axial portion of track 44D.

It will be appreciated that, when the follower 45 is in the wedge-shaped area 44C of the guide track, the sleeve (to which this finger is connected axially by the arm 46) cannot rise; such a position of the follower is a stable position of the resiliently compressible device that determines for the sleeve a low stable configuration, which is the stable configuration in which this sleeve is close to the base of the top.

On the other hand, when the finger rises as far as the portion in the form of a point 44A, or beyond that into the axial portion 44C, the sleeve is in an instantaneous high configuration, in which this sleeve is spaced apart considerably relative to the base of the top.

According to a variant (not represented), when the portion in the form of a point is not extended by the axial portion 44D, the high position of the finger 45 in this point 44A determines the highest position of the sleeve relative to the top, in which case this position is a high stable position of the sleeve.

However, in the example represented, the high stable position of the sleeve is determined by additional elements which the resiliently compressible device comprises. More particularly, at least some of the uprights of the added-on part comprise retention notches such as the one represented in FIG. 2 under the reference 56. These notches are designed to cooperate with bearing surfaces, one of which is represented under the reference 49 in FIG. 1, and is arranged on the outer surface of the sleeve on the low part of the latter. It will be appreciated that the opposition of the notches 56 of the added-on part and the bearing surfaces 49 of the sleeve defines a high stable position of this sleeve relative to the top. It will be appreciated that the presence of the endless portion of track 44D makes it possible not to have to carry out accurate positioning between the added-on part and the sleeve (and thus between the track and the finger) on the one hand, and between the bearing surfaces 49 and 56.

It will be appreciated that the fact that the added-on part comprises uprights on around only approximately 180° of its axis (i.e. three uprights which are angularly separated by an angle of 90°) allows the low part of the sleeve to be able to be engaged laterally in the added-on part.

More particularly, the tubular element of the container in FIG. 1 can be fitted together as follows:

- a first sub-assembly comprising the sleeve 42, the spring 43, the follower 45 with its pivoting arm 46 and the added-on part 50 are assembled,
- this sub-assembly is engaged in the cap from one or the other of its ends,
- the sub-assembly is positioned such that the base of the added-on part is flush with the low end of the cap, and the sub-assembly is immobilized such that the hooks 51, 52 are anchored in the wall of the cap by means of a harpooning effect.

The applicator element 3 is assembled in turn, and receives the stick by any appropriate means. It is then engaged in the sleeve.

Figure 3:
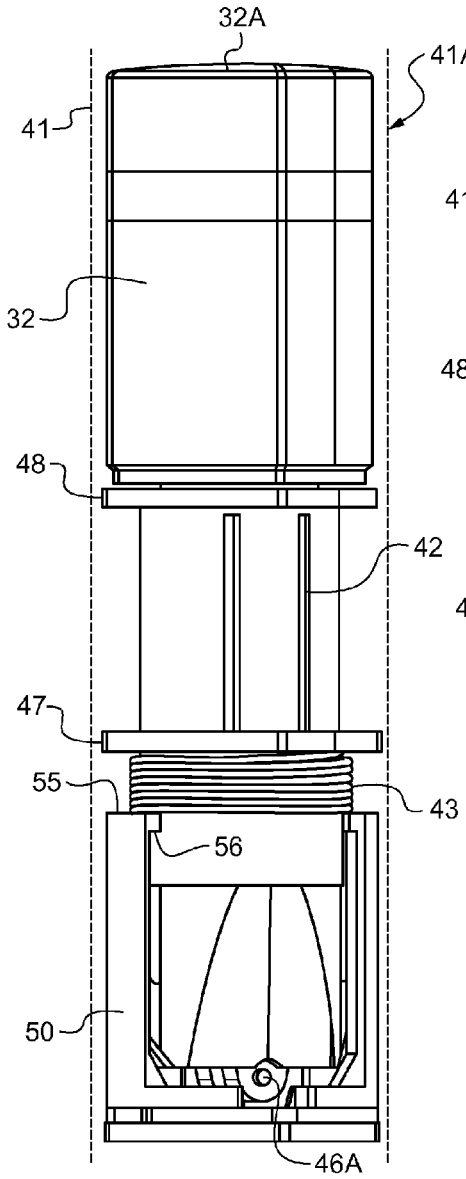
FIG. 3 is a partial lateral view of the device in FIG. 1 in the configuration in which the sleeve is retracted in the top.
Figure 4:
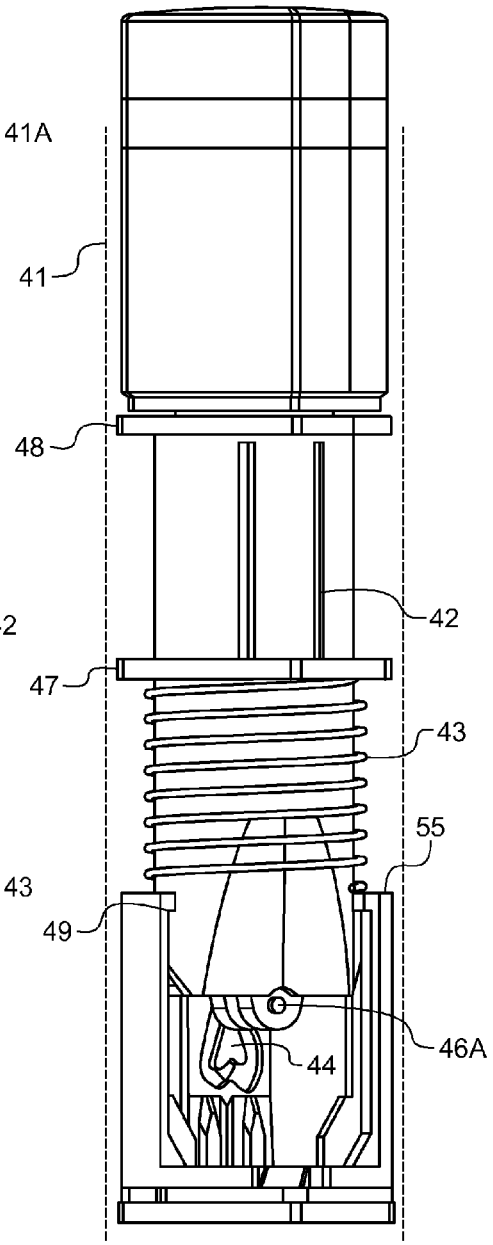
FIG. 4 is another view in an elongate configuration.

FIGS. 3 and 4 represent the applicator element engaged fully in the sleeve, with its base supported against the collar 48 of the sleeve. For the sake of legibility of the drawings, the cap is represented only in the form of broken lines which extend the added-on part along the outer surface of the assembly constituted by the base 32 and the sleeve.

In the configuration in FIG. 3, the follower (which cannot be seen) is engaged in the wedge-shaped portion of the guide track (which cannot be seen), such that the resiliently compressible device is in its low stable axial configuration; the sleeve is thus in its low stable position, whereas the resilient element is compressed (the coils of the spring which constitute this resilient element are represented as being virtually contiguous). In fact, as far as the follower is concerned, FIG. 3 shows only the section 46A of the pivoting axis of its arm.

In this configuration, the outermost surface 32A of the base 32 is flush with the level of the upper free edge 41A of the cap 41. The applicator element which is formed jointly by this base 32 and this tubular body 31 is then sufficiently retracted in the top, and thus in the storage element 4, to prevent grasping by the fingers of a user. This therefore gives a neat appearance. Also in this configuration, the base of the sleeve 42 can temporarily abut the base of the added-on part 50 when a substantial force is exerted on the sleeve, which can be the case on an assembly line, or in use, when the applicator element is re-engaged in the sleeve.

It will be appreciated that, as a variant, this retraction effect can be obtained even when the base projects slightly relative to the upper free edge of the top, for example when the outer surface of the base is concave.

Pressing this end surface 32A of the base, and therefore the applicator element, against the resilient element 43, gives rise to descent of the sleeve in the top, and therefore to descent of the follower relative to the guide track, towards one of the hollows of the portion in the form of a "W". As soon as the follower has passed beyond such a hollow of the portion in the form of a "W", the release of the pressure on the applicator element leaves the resilient element free to push the sleeve upwards, and therefore to push the follower towards the pointed high portion of this track; the sleeve thus rises in the cap as far as its high stable position, defined by the abutment of the support surface 49 against the notches 56. As can be seen in FIG. 4, the rising of the sleeve has then made the applicator element project relative to the cap by a distance which is sufficient to give a user, and more particularly the fingers of the user, a sufficient grip to permit the extraction of the applicator element from the sleeve and the top.

It can be estimated that a distance of approximately 10 to 15 mm is often appropriate to allow a user to grasp the base of the applicator element and extract it from the top. This distance can depend on the geometry of the parts.

It should be noted that, although the example described comprises a track supported by the added-on part which is integral with the top, whilst the follower is connected to the sleeve, an inverse configuration is possible, with a guide track provided on the outer surface of the low part of the sleeve, and a follower which is integral with the added-on part (the orientation of the heart shape of the track is then inverted).

Similarly, whereas in the example described there is a single track and a single finger, as a variant it is possible to arrange a pair (track+finger) in two (or more) of the lateral spaces; it appears however that it is preferable to implant only a single track and a single finger, since this is compatible with the aforementioned lateral fitting together, whilst avoiding having to position each track (and each finger) accurately relative to another track (and another finger).

Figure 5:
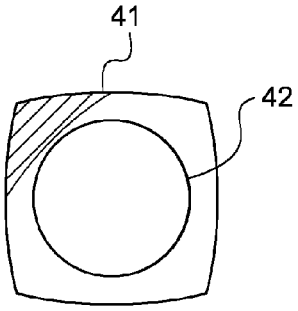
FIG. 5 is a diagram showing the transverse cross-sections of the cap and sleeve of the container in FIGS. 1 to 4.

FIG. 5 represents schematically the forms of the transverse cross-sections of the cap and the sleeve, at the level of the location of the guide track and the follower (not represented). It can be seen that, since the cross-section of the cap is globally square with these rounded sides and corners, whereas the cross-section of the sleeve is circular, there are as many lateral spaces as there are corners, i.e. four lateral spaces. The upper left corner is hatched in order to show the location of the track and the follower. As a variant, the cap has a polygonal cross-section, preferably with equal sides, for example in the form of a pentagon or a hexagon.

Figure 6:
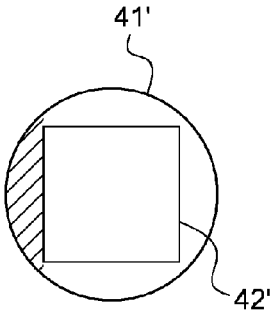
FIG. 6 is a diagram showing a first variant embodiment of a container according to the invention.
Figure 7:
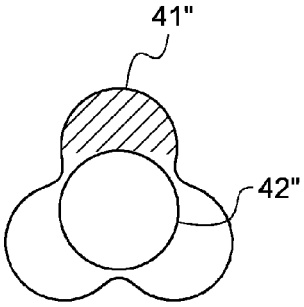
FIG. 7 is a diagram showing a second variant embodiment of a container according to the invention.

However, this configuration is not the only one possible. FIGS. 6 and 7 represent variant embodiments.

FIG. 6 thus represents a configuration in which the sleeve 42' has a square cross-section, whereas the cap 41' has a circular cross-section. It will be appreciated that four lateral spaces are thus obtained opposite each of the sides of the sleeve. FIG. 7 represents a sleeve 42" with a circular cross-section as previously described, whereas the cap has a cross-section with a complex form dictated by the inspiration of the designer, which in this case is the form of a trefoil; this therefore provides as many lateral spaces as there are petals on the trefoil.

It will be understood that the collar 47 of the sleeve acts not only as an axial scap for the resilient element 43, but also, together with the collar 48 (or any other collar provided for this purpose), creates an effect of guiding by sliding of the sleeve in the top. These collars can be formed solely by radial extensions which are circumferentially distributed around the sleeve, when the latter has a circular cross-section with a diameter which is substantially equal to the width of the cap (in this case the dimension of each of its sides).

It can be understood that the above-described container combines good use of the volume of the cap (in order to provide in it a sleeve which is as large as possible, and therefore a tubular body which is as large as possible, and therefore a stick which is as voluminous as possible), a neat appearance, and great reliability and flexibility of use.

The invention claimed is:

1. A container, comprising:

an applicator element comprising a base and a tubular body, wherein the tubular body is connected axially to the base, and wherein the applicator element is adapted to displace a stick of product axially relative to the base, and a tubular storage element comprising a cap comprising a mobile sleeve, wherein:

the cap is adapted to cover the applicator element in a configuration of maximum insertion of the applicator element in the sleeve, the sleeve is connected to the cap by a resiliently compressible device having two axial positions that are stable relative to the configuration of maximum insertion, the resiliently compressible device comprises a resilient element adapted to thrust the sleeve towards an open end of the cap, the tubular storage element comprises a heart-shaped guide track located between the cap and the sleeve and arranged parallel to an axial direction of the tubular storage element, the resiliently compressible device comprises a follower supported by an axial arm that is adapted to pivot to follow the guide track, and the guide track, the follower, and the resilient element are located in a lateral space between the cap and the sleeve;

further wherein the two axial positions comprise:

a low stable position wherein the follower is located in a wedge-shaped area of a portion of the guide track in the shape of a "W" and the applicator element is retracted in the storage element to effectively prevent fingers of a user to grip the applicator element, and a high stable position wherein the applicator element is engaged to the maximum extent in the sleeve but projects from the cap a distance effective to allow the fingers of a user to grip and extract the applicator element from the cap.

2. The container of claim 1, wherein a transverse cross-section of the sleeve is circular and a transverse cross-section of the cap comprises lateral spaces distributed circumferentially around the sleeve.

3. The container of claim 2, wherein the transverse cross-section of the cap is polygonal or approximately polygonal, and the lateral space is located in a wedge-shaped area of the cross section.

4. The container of claim 1, wherein the sleeve and the cap have constant cross-sections along their entire axial length.

5. The container of claim 1, wherein the resilient element is located axially between the guide track and the follower and the open end of the cap.

6. The container of claim 1, wherein the resiliently compressible device additionally comprises axial support surfaces respectively located on the sleeve and on an added-on part that is engaged in the lateral space inside the cap near the base of the cap, wherein the axial support surfaces contact each other under the thrust of the resilient element to define the high stable position of the sleeve.

7. The container of claim 6, wherein the heart-shaped guide track comprises, opposite the portion in the shape of a "W", a wedge shaped portion that is extended by an axial track portion.

8. The container of claim 1, wherein the heart-shaped guide track and the follower are located between an end part of the sleeve close to a base of the cap, and an added-on part that is engaged in the lateral space inside the cap near the base of the cap.

9. The container of claim 8, wherein the added-on part and the end part of the sleeve comprise axial support surfaces, wherein the axial support surfaces contact each other to define the high stable position of the sleeve.

10. The container of claim 9, wherein the added-on part is adapted to permit transverse engagement of the sleeve in the added-on part.

11. The container of claim 9, wherein said container contains a collar around the outer surface of the sleeve and the resilient element is located axially around the sleeve between said collar and the added-on part.

12. The container of claim 1, wherein the heart-shaped guide track is integral to the cap near a base of the cap, further wherein the arm connecting the follower to the sleeve is adapted to pivot around a transverse axis located in the vicinity of the end of the sleeve furthest away from the open end of the cap.

* * * * *